US008105178B2

(12) United States Patent
Sander

(10) Patent No.: US 8,105,178 B2
(45) Date of Patent: Jan. 31, 2012

(54) SIDE LOCKING ADJUSTABLE SHAFT CONNECTION SYSTEMS FOR REMOVABLY CONNECTING A GOLF CLUB HEAD AND SHAFT

(75) Inventor: Raymond J. Sander, Benbrook, TX (US)

(73) Assignee: Nike, Inc., Beaverton, OR (US)

( * ) Notice: Subject to any disclaimer, the term of this patent is extended or adjusted under 35 U.S.C. 154(b) by 178 days.

(21) Appl. No.: 12/509,272

(22) Filed: Jul. 24, 2009

(65) Prior Publication Data

US 2011/0021282 A1 Jan. 27, 2011

(51) Int. Cl.
*A63B 53/02* (2006.01)

(52) U.S. Cl. ..... 473/288; 473/307

(58) Field of Classification Search ..... 473/288, 473/307, 244–248; 403/315–320
See application file for complete search history.

(56) References Cited

U.S. PATENT DOCUMENTS

| | | | | |
|---|---|---|---|---|
| 796,802 | A | 8/1905 | Brown | |
| 1,769,235 | A | 7/1930 | Samaras et al. | |
| 1,802,507 | A | 4/1931 | Hadden | |
| 1,882,509 | A | 10/1932 | Lagerblade | |
| 1,983,069 | A | 12/1934 | Cowdery | |
| 2,001,342 | A | 5/1935 | Dyce | |
| 2,027,452 | A | 1/1936 | Rusing | |
| 3,572,709 | A | 3/1971 | Risher | |
| 4,943,059 | A | 7/1990 | Morell | |
| 4,948,132 | A * | 8/1990 | Wharton | 473/246 |
| 5,433,442 | A | 7/1995 | Walker | |
| 5,603,666 | A | 2/1997 | Bowe | |
| 5,997,409 | A | 12/1999 | Mattson | |
| 6,001,027 | A | 12/1999 | Hansberger | |
| 6,475,100 | B1 | 11/2002 | Helmstetter et al. | |
| 6,547,673 | B2 | 4/2003 | Roark | |
| 6,620,053 | B2 | 9/2003 | Tseng | |
| 6,638,178 | B2 | 10/2003 | Tseng | |
| 6,769,996 | B2 | 8/2004 | Tseng | |
| 6,863,622 | B1 | 3/2005 | Hsu | |

(Continued)

FOREIGN PATENT DOCUMENTS

JP 5-200708 * 8/1993

OTHER PUBLICATIONS

International Search Report in corresponding PCT Application, International Application No. PCT/US2010/038599, mailed Oct. 4, 2010.

*Primary Examiner* — Stephen L. Blau
(74) *Attorney, Agent, or Firm* — Banner & Witcoff, Ltd.

(57) ABSTRACT

Releasable golf club head/shaft connection systems and methods allow one to change shafts on a single club head, change club heads on a single shaft, and/or change the angular orientation features of a golf club. Such systems may include: (a) a club head body including a hosel and a locking nut stabilizer; (b) a shaft releasably engaged with the club head body, wherein an end of the shaft includes a retaining member that is inserted into the club head body; and (c) a locking nut engaged with a side surface of the club head body such that a body portion of the locking nut extends at least partially through the hosel and is supported by the locking nut stabilizer. The locking nut is movably engaged with the club head body such that it securely holds the shaft or allows the shaft to be removed therefrom.

27 Claims, 7 Drawing Sheets

U.S. PATENT DOCUMENTS

| | | | | |
|---|---|---|---|---|
| 7,083,529 | B2 | 8/2006 | Cackett et al. | |
| 7,226,364 | B2 | 6/2007 | Helmstetter | |
| 7,232,376 | B2 | 6/2007 | Droppleman | |
| 7,291,073 | B2 | 11/2007 | Park | |
| 7,326,126 | B2 | 2/2008 | Holt et al. | |
| 7,354,353 | B2 | 4/2008 | Hocknell et al. | |
| 7,438,645 | B2 | 10/2008 | Hsu | |
| 2005/0049072 | A1* | 3/2005 | Burrows | 473/305 |
| 2006/0183564 | A1 | 8/2006 | Park | |
| 2007/0078026 | A1 | 4/2007 | Holt et al. | |
| 2008/0051211 | A1 | 2/2008 | Hocknell et al. | |
| 2008/0119301 | A1 | 5/2008 | Holt et al. | |
| 2008/0293510 | A1* | 11/2008 | Yamamoto | 473/308 |

* cited by examiner

SIDE LOCKING ADJUSTABLE SHAFT CONNECTION SYSTEMS FOR REMOVABLY CONNECTING A GOLF CLUB HEAD AND SHAFT

FIELD OF THE INVENTION

This invention relates generally to golf clubs and golf club heads. More particularly, aspects of this invention relate to golf clubs having releasable connections between the golf club head and the shaft and head/shaft position adjusting features to allow easy interchange of shafts and heads and to allow easy modification of the head/shaft positioning properties.

BACKGROUND

Golf clubs have been the subject of much technological research and advancement in recent years. For example, the market has seen dramatic changes and improvements in putter designs, golf club head designs, shafts, and grips in recent years. Additionally, other technological advancements have been made in an effort to better match the various elements and/or characteristics of the golf club and characteristics of a golf ball to a particular user's swing features or characteristics (e.g., club fitting technology, ball launch angle measurement technology, ball spin rates, etc.).

Given the recent advances in golf, there is a vast array of golf club component parts available to the golfer. For example, club heads are produced by a wide variety of manufacturers in a variety of different models. Moreover, the individual club head models may include multiple variations, such as variations in the loft angle, lie angle, offset features, weighting characteristics, etc. (e.g., draw biased club heads, fade biased club heads, neutrally weighted club heads, etc.). Additionally, the club heads may be combined with a variety of different shafts, e.g., from different manufacturers; having different stiffnesses, flex points, kick points, or other flexion characteristics, etc.; made from different materials; having different masses or dimensions; etc.). Between the available variations in shafts and club heads, there are literally hundreds of different club head/shaft combinations available to the golfer.

Club fitters and golf professionals can assist in fitting golfers with a golf club head/shaft combination that suit their swing characteristics and needs. Conventionally, however, golf club heads are permanently mounted to shafts using cements or adhesives. Therefore, to enable a golfer to test a variety of head/shaft combinations, the club fitter or professional must carry a wide selection of permanently mounted golf club head/shaft combinations (which takes up a considerable amount of storage space and inventory costs) or the club fitter or professional must build new clubs for the customer as the fitting process continues (which takes a substantial amount of time and inventory costs). The disadvantages associated with these conventional options serve to limit the choices available to the golfer during a fitting session and/or significantly increase the expense and length of a session. Moreover, a permanently bonded club head and shaft connection limits the golfer's options as play conditions change from round to round and/or as his/her swing changes over time.

SUMMARY

The following presents a general summary of aspects of the invention in order to provide a basic understanding of this invention. This summary is not intended as an extensive overview of the invention. It is not intended to identify key or critical elements of the invention or to delineate the scope of the invention. The following summary merely presents some concepts of the invention in a general form as a prelude to the more detailed description provided below.

Aspects of this invention relate to golf club heads, golf clubs, releasable golf club head/shaft connection systems, and methods of assembling and using such golf clubs. Features of this invention allow, in at least some example structures, an easy to use quick-turn (e.g., ¼ turn) locking nut mechanism to easily and securely attach a golf club head to a shaft. Golf club heads, golf clubs, and golf club head/shaft connection assemblies in accordance with examples of this invention may include one or more of the following: (a) a club head body including a hosel portion, wherein an interior of the club head body includes a locking nut stabilizer, wherein the locking nut stabilizer is engaged with the club head body or is integrally formed in the interior of the club head body; (b) a shaft adapter releasably engaged with the club head body, wherein a first end of the shaft adapter includes a retaining member that is inserted into the hosel portion of the club head body; (c) a shaft engaged with the shaft adapter (optionally, if desired, the shaft may be integrally formed with the retaining member such that the shaft adapter may be omitted); and (d) a locking nut engaged with a side surface of the club head body (e.g., in the club head's heel area) such that a body portion of the locking nut extends at least partially through the hosel portion and is supported by the locking nut stabilizer, wherein the body portion of the locking nut includes an opening defined therein, wherein the opening includes an enlarged portion that allows the retaining member to pass through and a narrowed portion for holding the retaining member in engagement with the locking nut, and wherein the locking nut is engaged with the club head body in a movable manner such that the locking nut is movable with respect to the retaining member so as to convert the shaft adapter between a secured condition and a releasable condition with respect to the locking nut.

In order to provide adjustability of the various angles and orientations of the club head with respect to the shaft (e.g., the club's lie angle, loft angle, face angle, etc.), the shaft adapter may be provided with an exterior surface that is symmetric about a first axis and an interior chamber for receiving the free end of the shaft member, wherein the interior chamber is symmetric about a second axis that is non-parallel with the first axis. Additionally or alternatively, if desired, the club head adapter (if any) may similarly include an exterior surface that is symmetric about a first axis and an interior chamber for receiving the shaft adapter, wherein the interior chamber of the club head adapter is symmetric about a second axis that is non-parallel with the first axis.

Methods of assembling golf clubs and/or using the connection assemblies described above may include, for example, one or more of the following steps: (a) providing a club head body including a hosel portion, wherein an interior of the club head body includes a locking nut stabilizer, wherein the locking nut stabilizer is engaged with the club head body or is integrally formed in the interior of the club head body; (b) providing a shaft, wherein a first end of the shaft includes a retaining member (e.g., a ball joint); (c) engaging a locking nut with a side surface of the club head body such that a body portion of the locking nut extends at least partially through the hosel portion and is supported by the locking nut stabilizer, wherein the body portion of the locking nut includes an opening defined therein, wherein the opening includes an enlarged portion and a narrowed portion; (d) inserting the first end of the shaft into the hosel portion such that the retaining member at least partially passes through the enlarged portion of the opening in the locking nut body portion; (e) moving (e.g., rotating) the locking nut with respect to the retaining member such that the retaining member moves from an area adjacent the enlarged portion of the opening to an area adjacent the narrowed portion of the opening to thereby engage the shaft with the club head body at a first position; (f) engaging a shaft adapter with a shaft member, wherein the shaft adapter includes the retaining member (e.g., a ball joint); (g) engaging a head adapter with the hosel portion of the club head body, wherein the head adapter (and optionally the shaft adapter, when present) includes structures for inhibiting rotation of the shaft with respect to the club head body within the hosel portion; (h) moving (e.g., rotating) the locking nut with respect to the retaining member such that the retaining member moves from the area adjacent the narrowed portion of the opening to the area adjacent the enlarged portion of the opening; (i) removing the shaft from the locking nut by pulling the retaining member away from the locking nut body portion and through the enlarged portion of the opening; (j) rotating the shaft with respect to the club head body to a second position that is different from the first position; (k) inserting the first end of the shaft into the hosel portion at the second position such that the retaining member at least partially passes through the enlarged portion of the opening in the locking nut body portion; and/or (l) moving (e.g., rotating) the locking nut with respect to the retaining member such that the retaining member moves from the area adjacent the enlarged portion of the opening to the area adjacent the narrowed portion of the opening to thereby engage the shaft with the club head body at the second position.

In a similar manner, as another aspect of this invention, rather than simply rotating the shaft with respect to the club head body, one shaft may be pulled out of the club head body and a different shaft may be inserted thereon in its place. As another example aspect of this invention, one club head body may be removed from the shaft and replaced with a different club head body on the same shaft.

BRIEF DESCRIPTION OF THE DRAWINGS

A more complete understanding of the present invention and certain advantages thereof may be acquired by referring to the following detailed description in consideration with the accompanying drawings, in which like reference numbers indicate like features, and wherein.

DETAILED DESCRIPTION

Figure 1A:
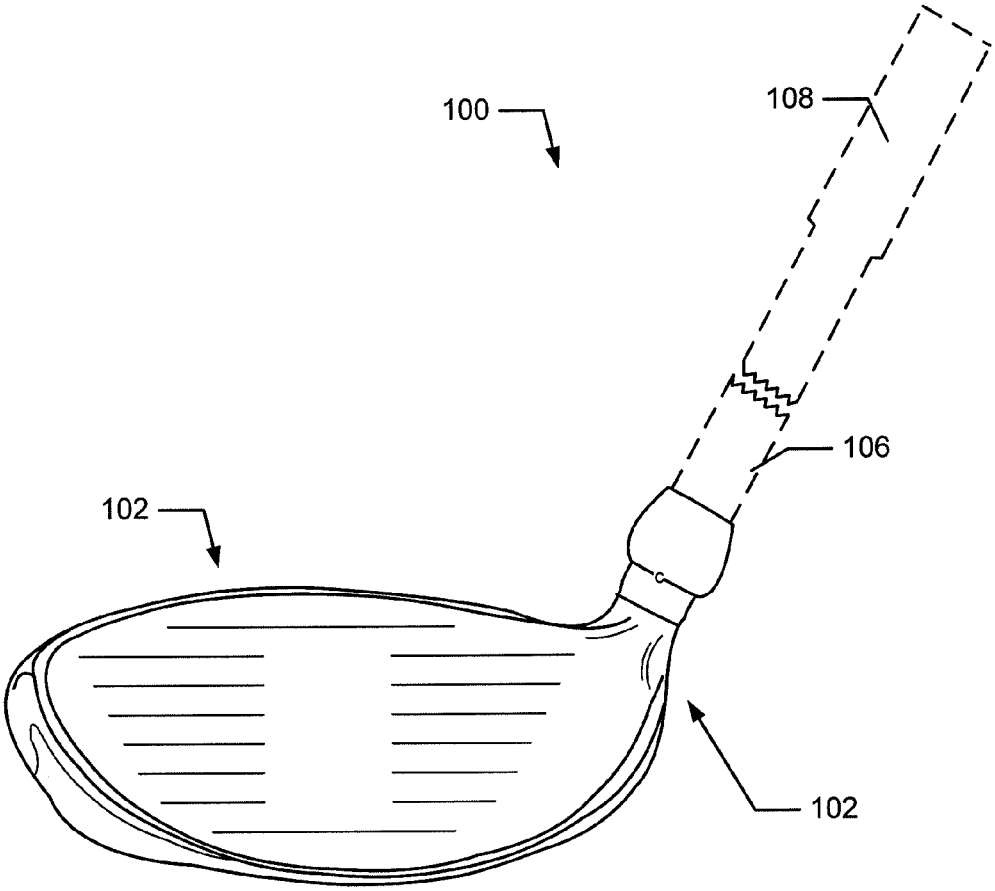
FIG. 1A generally illustrates a front view of an example golf club according to this invention.

In the following description of various example golf club heads and other aspects of this invention, reference is made to the accompanying drawings, which form a part hereof, and in which are shown by way of illustration various example structures, systems, and steps in which aspects of the invention may be practiced. It is to be understood that other specific arrangements of parts, structures, example devices, systems, and steps may be utilized and structural and functional modifications may be made without departing from the scope of the present invention. Also, while the terms "top," "bottom," "front," "back," "side," and the like may be used in this specification to describe various example features and elements of the invention, these terms are used herein as a matter of convenience, e.g., based on the example orientations shown in the figures and/or the orientations during typical use. Nothing in this specification should be construed as requiring a specific three dimensional orientation of structures in order to fall within the scope of this invention.

At least some example aspects of this invention relate to golf club heads, golf clubs, releasable golf club head/shaft connection systems, and methods of assembling and using such golf clubs. A general description of aspects of the invention followed by a more detailed description of specific examples of the invention follows.

A. General Description of Golf Club Heads, Golf Clubs, Releasable Golf Club Head/Shaft Connection Systems, and Methods According to Aspects of the Invention In general, aspects of this invention relate to golf club heads, golf clubs, releasable golf club head/shaft connection systems, and methods of assembling and using such golf clubs. General examples of features and aspects of this invention are described below.

1. Example Golf Clubs, Golf Club Heads, and Golf Club Head/Shaft Connection Assemblies According to this Invention Golf club heads and golf clubs in accordance with examples of this invention may include one or more of the following: (a) a club head body including a hosel portion, wherein an interior of the club head body includes a locking nut stabilizer, wherein the locking nut stabilizer is engaged with the club head body or is integrally formed in the interior of the club head body; (b) a shaft adapter releasably engaged with the club head body, wherein a first end of the shaft adapter includes a retaining member that is inserted into the hosel portion of the club head body; (c) a shaft engaged with the shaft adapter (optionally, if desired, the shaft may be integrally formed with the retaining member such that the shaft adapter may be omitted); and (d) a locking nut engaged with a side surface of the club head body (e.g., in the club head's heel area) such that a body portion of the locking nut extends at least partially through the hosel portion and is supported by the locking nut stabilizer, wherein the body portion of the locking nut includes an opening defined therein, wherein the opening includes an enlarged portion that allows the retaining member to pass through and a narrowed portion for holding the retaining member in engagement with the locking nut, and wherein the locking nut is engaged with the club head body in a movable manner such that the locking nut is movable with respect to the retaining member so as to convert the shaft adapter between a secured condition and a releasable condition with respect to the locking nut.

Optionally, if desired, the club head body may include a head adapter engaged with the hosel portion to provide a mechanism with which the shaft adapter may be engaged. The head adapter and the shaft adapter may be provided with rotation inhibiting structures to prevent rotation of the shaft member with respect to the club head within the hosel portion.

Furthermore, in some example golf club head and golf club structures in accordance with this invention, the retaining member may be formed as a ball joint, and wherein the opening defined in the body portion of the locking nut includes a hole (e.g., a round hole) as the enlarged portion that is large enough for the ball joint to pass and a slot extending from the hole as the narrowed portion that is small enough so that the ball joint cannot pull back out of the locking nut.

In order to provide adjustability of the various angles and orientations of the club head with respect to the shaft (e.g., the club's lie angle, loft angle, face angle, etc.), the shaft adapter may be provided with an exterior surface that is symmetric about a first axis and an interior chamber for receiving the free end of the shaft member, wherein the interior chamber is symmetric about a second axis that is non-parallel with the first axis. While any desired angle may be provided between these two axes, in at least some examples of this invention the angle between the first axis and second axis will be within a range of 0.25 to 8 degrees, and in some structures, within a range of 0.5 to 4 degrees or even within a range of 0.75 to 2 degrees. Additionally or alternatively, if desired, the club head adapter (if any) may similarly include an exterior surface that is symmetric about a first axis and an interior chamber for receiving the shaft adapter, wherein the interior chamber of the club head adapter is symmetric about a second axis that is non-parallel with the first axis. Again, while any desired angle may be provided between these two axes, in at least some examples of this invention the angle between the first axis and second axis will be within a range of 0.25 to 8 degrees, and in some structures, within a range of 0.5 to 4 degrees or even within a range of 0.75 to 2 degrees.

The locking nut and locking nut stabilizer mentioned above may have a variety of different constructions without departing from this invention. In essence, the locking nut stabilizer supports the free end of the locking nut so that the shaft member is not free to move up and down with respect to the hosel portion. In some example structures in accordance with this invention, the locking nut includes a support member that extends from the locking nut body portion and that engages with an opening or recess provided in the locking nut stabilizer to engage the locking nut with the locking nut stabilizer in a rotatable manner. The support member on the locking nut may constitute a shaft, a ball joint, or other structure. As another example, the locking nut in some example structures according to this invention includes an opening or recess that engages with a projection (e.g., shaft, ball joint, protrusion, etc.) provided on the locking nut stabilizer to engage the locking nut with the locking nut stabilizer in a rotatable manner. As yet another example, if desired, the locking nut stabilizer may include curved supports located above and/or below at least some of the body portion of the locking nut.

2. Methods of Assembling and/or Using Golf Clubs According Examples of this Invention Additional aspects of this invention relate to methods of assembling golf clubs of the various types described above. Such methods may include, for example, one or more of the following steps: (a) providing a club head body including a hosel portion, wherein an interior of the club head body includes a locking nut stabilizer, wherein the locking nut stabilizer is engaged with the club head body or is integrally formed in the interior of the club head body; (b) providing a shaft, wherein a first end of the shaft includes a retaining member (e.g., a ball joint); (c) engaging a locking nut with a side surface of the club head body such that a body portion of the locking nut extends at least partially through the hosel portion and is supported by the locking nut stabilizer, wherein the body portion of the locking nut includes an opening defined therein, wherein the opening includes an enlarged portion and a narrowed portion; (d) inserting the first end of the shaft into the hosel portion such that the retaining member at least partially passes through the enlarged portion of the opening in the locking nut body portion; and (e) moving (e.g., rotating) the locking nut with respect to the retaining member such that the retaining member moves from an area adjacent the enlarged portion of the opening to an area adjacent the narrowed portion of the opening to thereby engage the shaft with the club head body at a first position. Additionally, if desired, the methods may include one or more of the following steps: (f) engaging a shaft adapter with a shaft member, wherein the shaft adapter includes the retaining member (e.g., a ball joint); and/or (g) engaging a head adapter with the hosel portion of the club head body, wherein the head adapter (and optionally the shaft adapter, when present) includes structures for inhibiting rotation of the shaft with respect to the club head body within the hosel portion.

The club head body, locking nut, locking nut stabilizer, head adapter, shaft adapter, shaft, or other parts of the assembly may have any of the various features and/or characteristics described above.

Additional example aspects of this invention may include features for varying the various angles and orientations of the club head body with respect to the free end of the shaft. Such methods may include the steps of: (a) moving (e.g., rotating) the locking nut with respect to the retaining member such that the retaining member moves from the area adjacent the narrowed portion of the opening to the area adjacent the enlarged portion of the opening; (b) removing the shaft from the locking nut by pulling the retaining member away from the locking nut body portion and through the enlarged portion of the opening; (c) rotating the shaft with respect to the club head body to a second position that is different from the first position; (d) inserting the first end of the shaft into the hosel portion at the second position such that the retaining member at least partially passes through the enlarged portion of the opening in the locking nut body portion; and (e) moving (e.g., rotating) the locking nut with respect to the retaining member such that the retaining member moves from the area adjacent the enlarged portion of the opening to the area adjacent the narrowed portion of the opening to thereby engage the shaft with the club head body at the second position.

In a similar manner, as another aspect of this invention, rather than simply rotating the shaft with respect to the club head body, one shaft may be pulled out of the club head body and a different shaft may be inserted thereon in its place. As another example aspect of this invention, one club head body may be removed from the shaft and replaced with a different club head body on the same shaft. These features allow users of the invention (e.g., club fitters, individual players, etc.) to use different golf club head and shaft combinations.

Specific examples of the invention are described in more detail below. The reader should understand that these specific examples are set forth merely to illustrate examples of the invention, and they should not be construed as limiting the invention.

B. Specific Examples of the Invention

The various figures in this application illustrate examples of golf club heads, golf clubs, releasable golf club head/shaft connection systems, and methods in accordance with examples of this invention. When the same reference number appears in more than one drawing, that reference number is used consistently in this specification and the drawings to refer to the same or similar parts throughout.

Figure 1B:
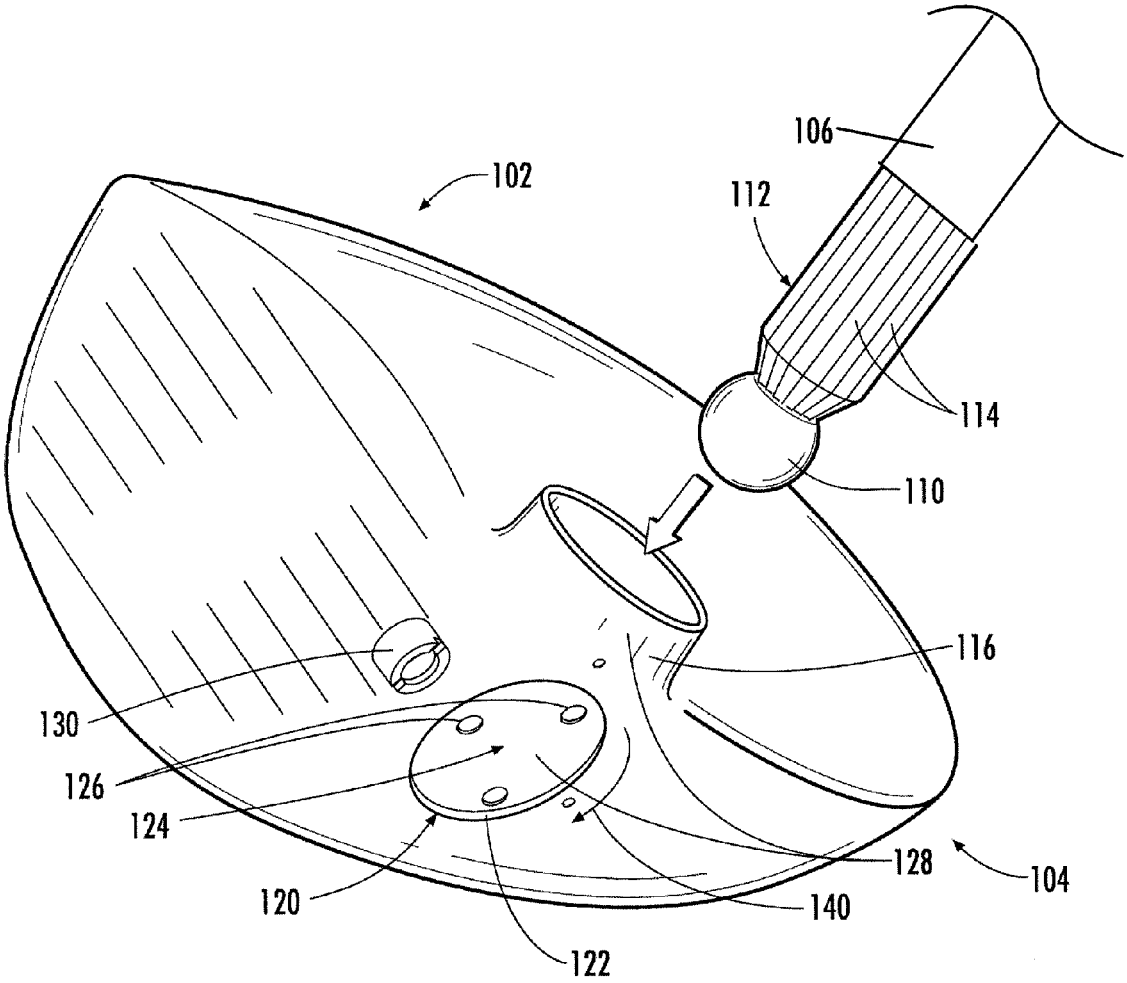
FIG. 1B illustrates an exploded perspective view of the club head and end of the shaft from FIG. 1A in accordance with this invention.

FIGS. 1A and 1B generally illustrate an example golf club in accordance with this invention. FIG. 1A is a front view of an assembled golf club and FIG. 1B is an exploded perspective view of the club head and end of the shaft. FIG. 1A generally illustrates an example golf club 100 in accordance with at least some examples of the invention. Golf club 100 includes a club head 102, a releasable club head/shaft connection system 104 that connects the club head 102 to a shaft 106 (which will be described in more detail below), and a grip member 108 engaged with the shaft 106. While a driver/wood-type golf club head 102 is illustrated in FIG. 1A, aspects of this invention may be applied to any type of club head, including, for example: fairway wood club heads; iron type golf club heads (of any desired loft, e.g., from a 0-iron or 1-iron to a wedge); wood or iron type hybrid golf club heads; putter heads; and the like. The club heads may be made from suitable materials, in suitable constructions, in suitable manners, as are known and used in the art, optionally modified (if necessary, e.g., in size, shape, etc.) to accommodate the releasable club head/shaft connection parts (as will be described in more detail below).

The various parts of the club head/shaft connection system 104 may be made from any desired or suitable materials without departing from this invention. For example, one or more of the various parts may be made from a metal material, including lightweight metals conventionally used in golf club head constructions, such as aluminum, titanium, magnesium, nickel, alloys of these materials, steel, stainless steel, and the like, optionally anodized finished materials. Alternatively, if desired, one or more of the various parts of the connection system 104 may be made from rigid polymeric materials, such as polymeric materials conventionally known and used in the golf club industry. The various parts may be made from the same or different materials without departing from this invention. In one specific example, each of the various parts will be made from a 7075 aluminum alloy material having a hard anodized finish. The parts may be made in suitable manners as are known and used in the metal working and/or polymer production arts.

Any desired materials also may be used for the shaft 106, including suitable materials that are known and used in the art, such as steel, graphite, polymers, composite materials, combinations of these materials, etc. Optionally, if necessary or desired, the shaft 106 may be modified (e.g., in size, shape, etc.) to accommodate the releasable club head/shaft connection parts 104. The grip member 108 may be engaged with the shaft 106 in any desired manner, including in any suitable manners that are known and used in the art (e.g., via cements or adhesives, via mechanical connections, etc.). Any desired materials may be used for the grip member 108, including suitable materials that are known and used in the art, such as rubber, polymeric materials, cork, rubber or polymeric materials with cord or other fabric elements embedded therein, cloth or fabric, tape, etc. Optionally, if desired, the grip member 108 (or any suitable handle member) may be releasably connected to the shaft 106 using a releasable connection like releasable connection 104 (examples of which will be described in more detail below).

The releasable connection 104 between golf club heads and shafts in accordance with some examples of this invention now will be described in more detail in conjunction with FIGS. 1B through 6C. As shown in FIG. 1B, the end of the shaft 106 may be equipped with a retaining member 110, such as a ball joint as illustrated in FIG. 1B. The retaining member 110 may be included as part of the shaft 106 in any desired manner without departing from this invention, such as by integrally forming the end of a golf club shaft to include the desired structures or by fitting the free end of a conventional golf club shaft member with a shaft adapter 112, wherein the shaft adapter 112 includes the retaining member 110. Additionally, if desired, at least some portion of an exterior surface of the shaft adapter 112 may include rotation inhibiting structures 114. While the illustrated example structure shows longitudinally oriented splines extending along the exterior surface of the shaft adapter as the rotation inhibiting structure 114, other example rotation inhibiting structures may be used without departing from this invention, such as structures with a non-round cross section, structures with a polygonal cross section (e.g., having 3 to 20 flat sides, etc.), semicircular cross sections, star shaped cross sections, irregularly shaped cross sections, etc. Moreover, while FIG. 1B shows the retaining member 110 as a ball joint, other example structures may be used without departing from this invention, such as more rectangular projection structures, etc.

As shown in FIG. 1B, the end of the shaft 106 (including the shaft adapter structure 112 in this example structure) is inserted into a hosel portion 116 of the club head body 102. The hosel portion 116 may take on a variety of different sizes, shapes, and constructions without departing from this invention, including conventional sizes, shapes, and constructions as are known and used in the art. For example, the hosel portion 116 may extend upward from the club head crown surface any desired distance without departing from this invention, or it may have any desired diameter or shape (internal or external) without departing from this invention. Moreover, the hosel portion 116 may include structures internal to the club head body 102, e.g., engaged with or integrally formed at the heel portion of the club head body, at the crown portion of the club head body, at the sole portion of the club head body, etc. If desired, the entire hosel portion 116 may be located internal to the club head structure 102 such that only an opening in the top (or crown) of the club head appears for receiving the shaft 106.

FIG. 1B further illustrates the inclusion of a locking nut 120 on a side surface of the club head body 102. This illustrated example locking nut 120 is provided on the heel portion of the club head body 102, alongside the hosel portion 116. The term "heel portion" of the club head body 102, as used herein, means the side of the club head body at which the shaft 106 is mounted. For a wood-type golf club head, the "heel portion" includes at least the side of the club head body 102 at which the shaft 106 is mounted extending rearward from the ball striking face at least 50% of an overall maximum front-to-rear dimension of club head body. While shown in FIG. 1B as mounted in the heel portion of the club head body 102, the locking nut 120 could be mounted at other locations on the club head body 102 without departing from this invention, such as in a rear portion of the club head body 102 toward the heel side, at a toe portion of the club head body, etc.

If desired, as illustrated in FIG. 1B, the locking nut 120 may be mounted within a recess 122 provided in the club head surface. Optionally, the surface of the head 124 of the locking nut 120 may be shaped so as to lie flush with the contour of the club head body, at least when the locking nut 120 is in the secured condition, so that a smooth overall contour is shown in the club head. As another alternative, if desired, the head 124 of the locking nut 120 may be covered by a cover element (not shown) that may be sized, shaped, and contoured so as to provide an aesthetically pleasing overall club head structure.

As will be explained in more detail below with regard to the locking and securing functions of the locking nut 120, the locking nut 120 is rotatably mounted with respect to the club head body 102. If desired, the rotation of the locking nut may be limited, e.g., to a ¼ turn, ½ turn, one full turn, etc., to move the locking nut 120 between the secured condition and the releasable condition (as will be described in more detail below). The locking nut head 124 may include one or more structures 126 that enable it to be engaged by a tool (such as a wrench) to assist in rotating between the secured condition and the releasable condition. If desired, the locking nut 120, the club head body 102, or both, may include indicia 128 that allow a user to visually determine whether the locking nut 120 is in the secured condition or the releasable condition. Any desired type of indicia or information may be provided to convey information as to whether the locking nut 120 is in the secured condition or the releasable condition.

The locking nut 120 includes a body portion (not shown in FIG. 1B but described in more detail below) that extends across the hosel portion 116 of the club head 102. The end of the locking nut may be sized and shaped so that its free end engages and is supported by a locking nut stabilizer 130. The locking nut stabilizer 130 may be provided in the club head structure in any desired manner without departing from this invention, including by being attached to some portion of the club head body member (e.g., by cements or adhesives, by mechanical connectors, by fusing techniques (such as welding, brazing, soldering, etc.) such that the stabilizer support portions are located within the interior of the club head body. Alternatively, if desired, the locking nut 120 could extend across the entire club head body width and be supported by the opposite surface of the club head body 102 (e.g., in the toe portion of the club head body 102).

Figure 2A:
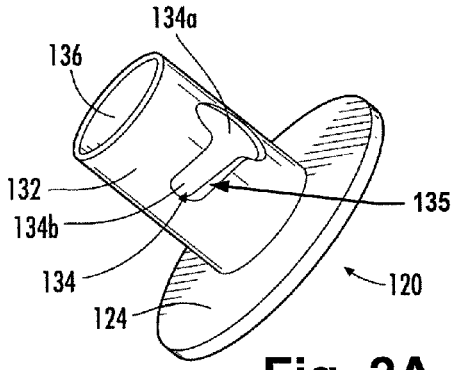
FIGS. 2A and 2B illustrate example locking nut structures in accordance with this invention.

FIG. 2A illustrates a more detailed view of an example locking nut structure 120, e.g., like that shown in FIG. 1B. As shown, the locking nut 120 includes a head 124 and a body portion 132 extending from the head 124. In this illustrated example, the head 124 is a relatively flat cylindrical disk and the body portion 132 includes a hollow cylinder that extends from one side of the head 124. The body portion 132 includes an opening 134 defined therein, along its circumferential surface. The opening 134 includes an enlarged opening portion 134*a* (e.g., a generally round hole in this illustrated example) and narrowed portion 134*b* (e.g., an elongated slot in this illustrated example), the purposes of which will be described in more detail below. The narrowed portion 134*b* of opening 134 extends around the body portion 132 such that the narrowed portion 134*b* is perpendicular to the central axis of the body portion 132. The overall opening 134 may extend any desired extent around the circumference of the body portion 132 without departing from this invention. In this illustrated example, the overall opening extends about ⅓ of the way around the circumference, but it may extend, for example, from 15 to 95% of the way around the circumference of the body portion 132, or even from 25% to 75% of the way around. The free end 136 of this example locking nut 120 includes an opening (or a concave recess) that will engage a locking nut stabilizer, e.g., of the type illustrated in FIG. 4 (and as described in more detail below).

Figure 2B:
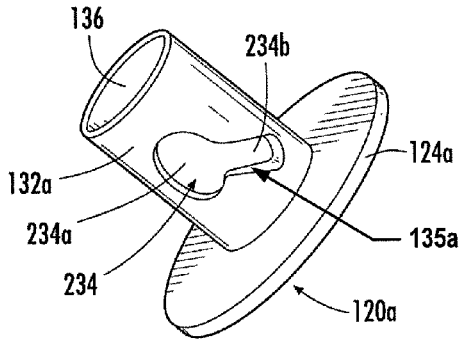

FIG. 2B illustrates an alternative example locking nut structure 120*a*. Like the locking nut 120 of FIG. 2A, the locking nut 120*a* of FIG. 2B includes a head 124*a* and a body portion 132*a* extending from the head 124*a*. In this illustrated example, the head 124*a* again is a relatively flat cylindrical disk and the body portion 132*a* includes a hollow cylinder that extends from one side of the head 124*a*. The free end 136*a* of this example locking nut 120*a* also includes an opening (or a concave recess) that will engage a locking nut stabilizer, e.g., of the type illustrated in FIG. 4 (and as described in more detail below).

The opening 234 of the body portion 132*a* of FIG. 2B differs from the opening 134 in FIG. 2A. More specifically, the opening 234 includes an enlarged opening portion 234*a* (e.g., a generally round hole in this illustrated example) and narrowed portion 234*b* (e.g., an elongated slot in this illustrated example), the purposes of which will be described in more detail below. The narrowed portion 234*b* of opening 234 extends around the body portion 132A such that the narrowed portion 234*b* extends at an angle with respect to the central axis of the body portion 132*a*. This angle helps pull the locking nut 120*a* tightly against the club head body 102 and holds it in place when the locking nut 120*a* is in the secured condition, as will be described in more detail below. The overall opening 234 may extend any desired extent around the circumference of the body portion 132*a* without departing from this invention. In this illustrated example, the overall opening extends about ⅓ of the way around the circumference, but it may extend, for example, from 15 to 95% of the way around the circumference of the body portion 132*a*, or even from 25% to 75% of the way around. Also, the overall opening 234 may extend any desired distance in the axial direction of the body portion 132*a*, such as from 15 to 95% of the overall axial dimension of the body portion 132*a*, or even from 25% to 75% of the overall axial dimension of the body portion 132*a*.

The locking nut 120, 120*a* may take on a variety of different sizes, shapes, and constructions without departing from this invention. For example, instead of a full cylinder, a portion of a cylinder (e.g., an arched surface) may be provided and used as the locking nut body member 132. The body member 132 also may have a variety of sizes, shapes, and features. The head 124 also may take on a wide variety of different sizes, shapes, and constructions without departing from this invention, including different structures for engaging a tool used for tightening and loosening the locking nut 120. Also, the free end 136 of the locking nut may take on a variety of different structures, some of which will be described in more detail below.

Figure 3:
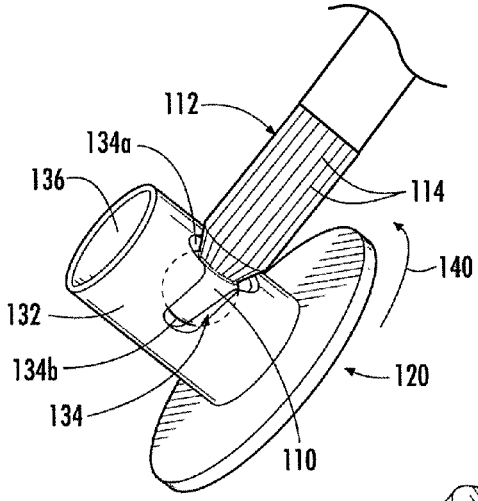
FIG. 3 illustrates an example golf club head/shaft connection via a shaft adapter and a locking nut arrangement in accordance with this invention.

FIG. 3 illustrates engagement of the shaft 106 (and particularly the shaft adapter 112) with a locking nut 120 in one example structure according to this invention. In this illustration, the various features of the club head body, such as the hosel, etc. are omitted so that the features of the shaft adapter 112 and the locking nut 120 can be better visualized. Nonetheless, the structures of FIG. 3 may be included in a golf club head structure 102 like that illustrated in FIG. 1B. As shown in FIGS. 1B and 3, as the shaft 106 is inserted into the hosel portion 116 of the club head body 102, the retaining portion 110 (e.g., ball joint) of the shaft adapter 112 extends into and at least partially through the enlarged portion 134*a* of the opening 134 of the locking nut 120 (and at least partially into the interior of the body portion 132 of locking nut 120). At this point in time, the shaft 106 and the shaft adapter 112 are in a releasable condition with respect to the club head body 102 such that the shaft 106 can be easily removed from the club head body 102. Optionally, as the shaft 106 slides into the hosel portion 116 of the club head body 102, the rotation inhibiting structures 114 on the shaft adapter 112 will engage one or more rotation inhibiting structures provided within the hosel portion 116. The one or more rotation inhibiting structures provided within the hosel portion 116 may be provided integrally and directly as part of the club head hosel structure itself, or they may be provided as part of a club head adapter that fits into the hosel portion 116, examples of which will be described in more detail below.

Once inserted into the hosel portion 116, the shaft 106 can be locked in place in the hosel by rotating the locking nut 120 in the direction of the arrows 140 shown in FIGS. 1B and 3. This action moves the opening 134 with respect to the retaining portion 110 such that the retaining portion 110 moves from an area adjacent the enlarged opening 134*a* to an area adjacent the narrowed opening 134*b*. The retaining portion 110 is sized and shaped so that it will not pull through the opening when located adjacent the narrowed opening 134*b*, to thereby place the shaft 106 in a locked or secured condition with respect to the club head body 102.

Figure 7A:
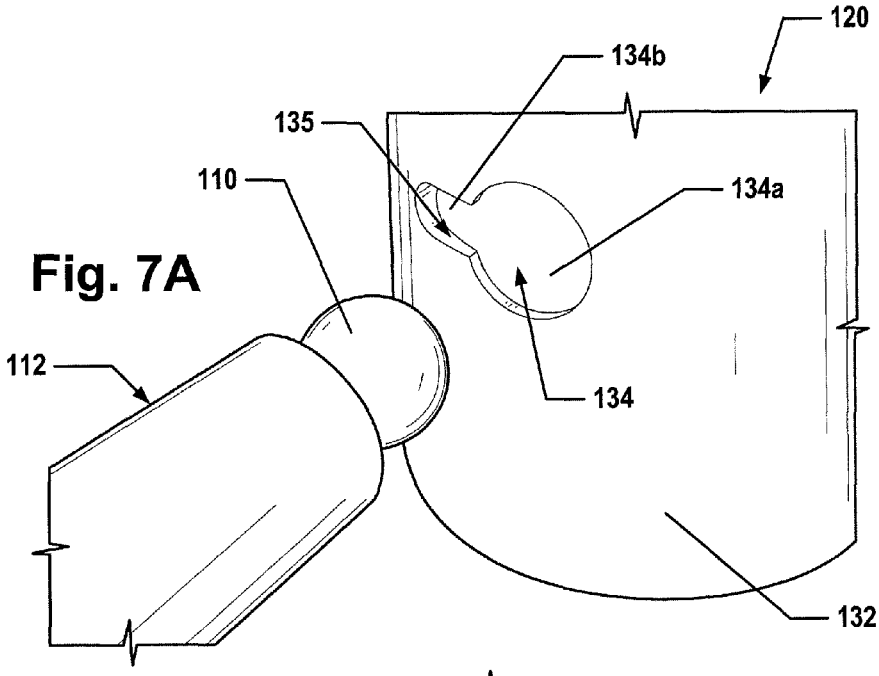
FIGS. 7A and 7B illustrate a close-up perspective view of an example opening on the locking nut in accordance with this invention.
Figure 7B:
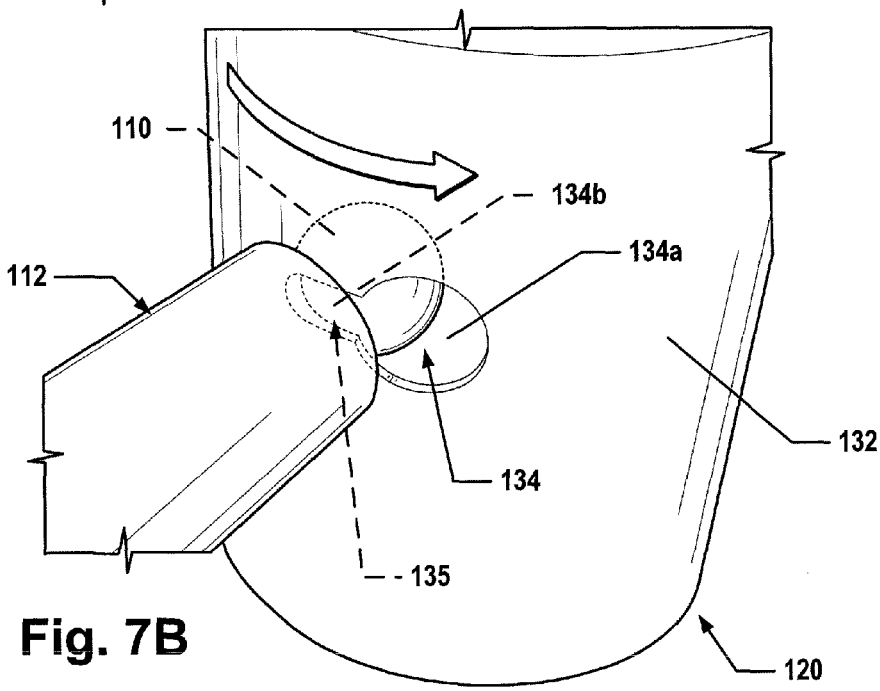

If desired, the various surfaces that engage one another as the retaining portion 110 moves from the area adjacent the enlarged opening 134*a* to the area adjacent the narrowed opening 134*b* may be sized and shaped so as to facilitate the motion and to provide a secure and tight fit. For example, when at least the upper portion of the retaining member 110 is rounded, spherical, or hemispherical shaped, this will facilitate movement of the retaining member 110 with respect to the body portion 132 by allowing the retaining member 110 to be gradually pulled downward into the interior of the body portion 132. Additionally or alternatively, if desired, the opening 134 may include a tapered engagement area 135. The tapered engagement area 135 may be thinner, tapered, or include a ramp type structure at the area where the opening transitions from the enlarged portion 134*a* to the narrowed portion 134*b*. The tapered engagement area 135 may facilitate movement and tightening of the retaining member 110 with respect to the body portion 132 by allowing the retaining member 110 to be gradually pulled downward into the interior of the body portion 132. The tapered engagement area 135 may provide a downward force pressure on the retaining member 110 as the locking nut 120 is rotated. The tapered engagement area 135 as described above is illustrated as a close-up view in FIGS. 7A and 7B as the locking nut 120 and the opening 134 is rotated in each of the two different views.

Figure 4:
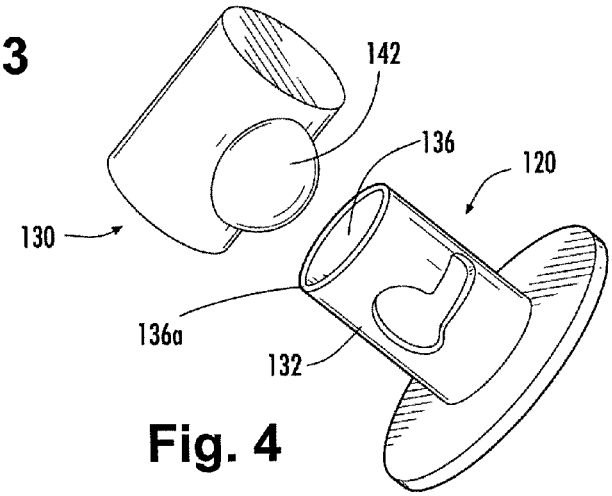
FIG. 4 illustrates an example connection between a locking nut and a locking nut stabilizer in accordance with this invention.

FIG. 4 additionally illustrates one example manner in which the locking nut 120 may engage a locking nut stabilizer 130 (which may be engaged with or integrally formed with the club head body and/or included within the club head interior). The locking nut stabilizer 130 may also be used to retain the locking nut 120 within the club head when the shaft adapter 112 is removed from the locking nut 120. As shown in this figure (as well as in FIGS. 2A, 2B, and 3), the body portion 132 of this example locking nut 120 includes a free end 136 having an opening or recess 136*a* defined therein. The locking nut stabilizer 130 of this example structure includes a projection portion 142 that is received within the opening or recess 136*a* of the locking nut 120 and engages and supports the locking nut 120 in a rotatable manner. The projection portion 142 may be rounded, tapered, or sloped so as to allow for a smooth and tight, yet rotatable fit. If desired, the projection portion 142 and/or the interior wall of the opening or recess 136*a* may be formed from suitable materials so as to allow for smooth rotation of the locking nut 120 with respect to the projection portion 142. As another alternative, if desired, a lubricant material may be provided between these various parts (e.g., coated on or embedded in the plastic of the projection portion 142 and/or the interior wall of the opening or recess 136*a*).

Figure 5:
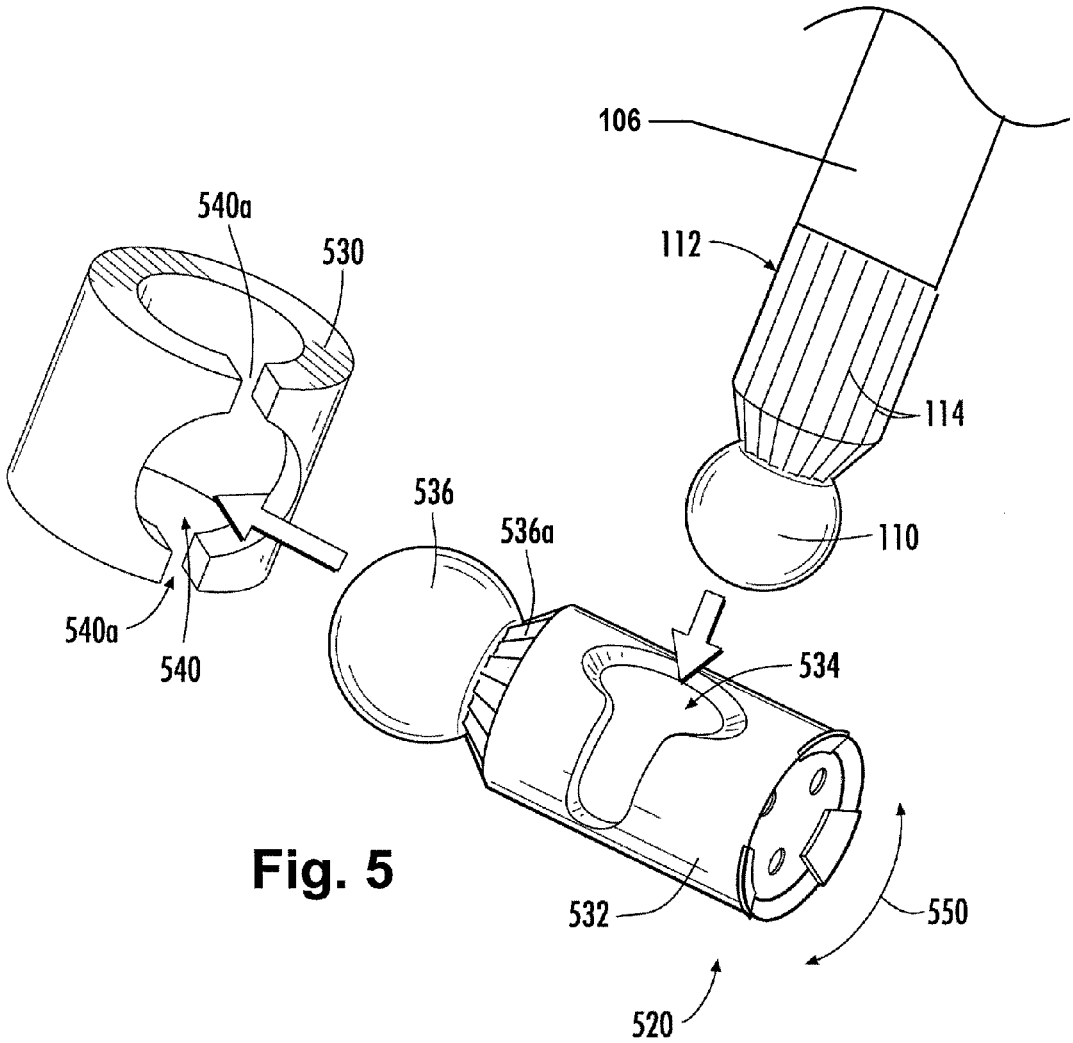
FIG. 5 illustrates an example golf club head/shaft connection via a shaft adapter, a locking nut, and a locking nut stabilizer in accordance with this invention.

FIG. 5 illustrates another example of a locking nut 520 and locking nut stabilizer 530 structure according to aspects of this invention. In this example structure, the locking nut 520 includes a head portion 524 for engaging a wrench and for rotating the locking nut between the releasable and secured conditions. The head 524 in this example structure is recessed somewhat into one end of the body portion 532. The body portion 532 includes an opening 534 having a similar construction to that shown in FIGS. 2A, 3, and 4, although different sizes and shapes of openings may be provided, if desired (e.g., having a square, rectangular, or other polygonal shaped enlarged opening, etc.).

The other free end of the locking nut 520 in this example structure includes a retaining member 536, such as a ball joint. This retaining member 536 may snap into the opening 540 provided in the locking nut stabilizer 530, which may be in the form of a grommet mounted within the interior of a club head body. In this illustrated example, the locking nut stabilizer 530 constitutes a hollow cylinder that has a continuous opening (540, 540*a*) extending along its axial length. The locking nut stabilizer 530 may be made from a rigid, yet flexible material (such as a rigid plastic material) such that the opening 540 will expand somewhat (due to the presence of the gaps 540*a* and the hollow interior structure) as the retaining member 536 pushes through and will then snap back to its original size and shape (or substantially its original size and shape) once the widest part of the retaining member 536 is pushed through. If desired, the opening 540 may be sized and shaped to relatively snugly fit around the base portion 536*a* of the retaining member. The opening 540 and the retaining member 536 may be appropriate sized and shaped, and the locking nut may be made from suitable materials, such that the locking nut cannot be released from the locking nut stabilizer 530 (or at least cannot be released easily, particularly with the recessed head 524 feature). Nonetheless, using this construction, the locking nut stabilizer 530 will hold the locking nut 520 in a rotatable manner, e.g., in the directions of arrow 550 in FIG. 5.

Figure 6A:
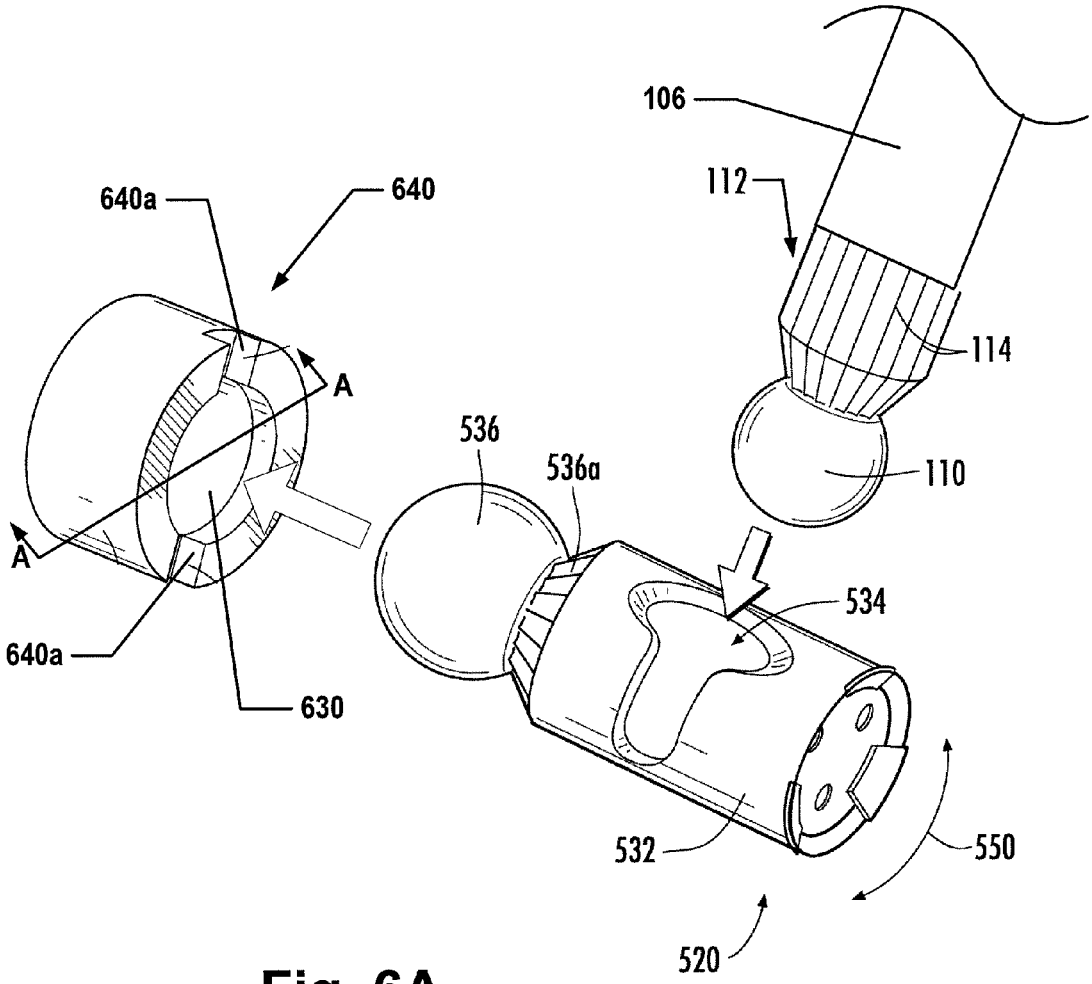
FIG. 6A illustrates another example locking nut stabilizer structure in accordance with this invention.
Figure 6B:
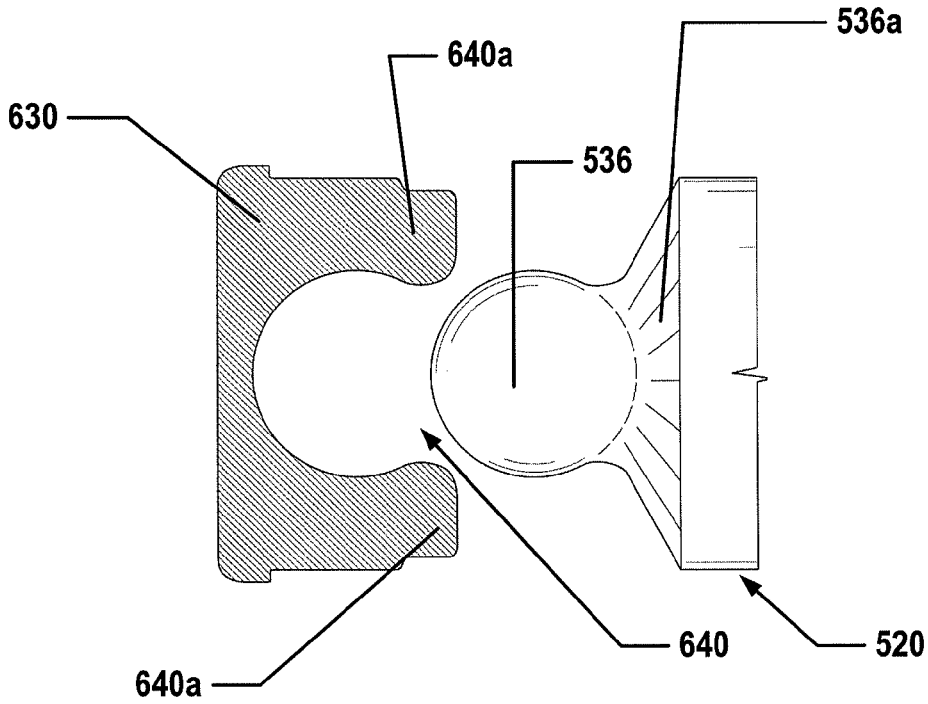
FIGS. 6B and 6C illustrate a cross section A-A of the locking nut stabilizer structure from FIG. 6A in accordance with this invention.
Figure 6C:
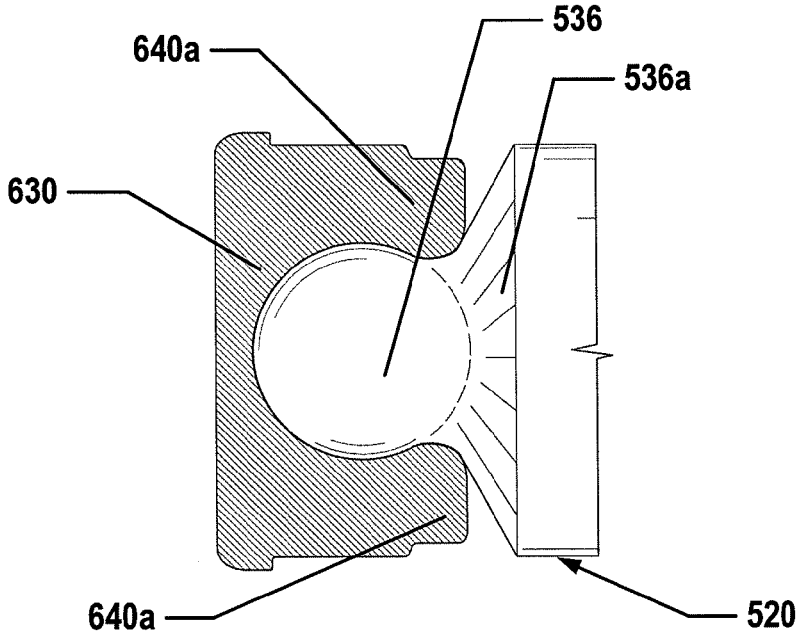

FIGS. 6A-6C illustrate another example locking nut stabilizer structure 630 that may be used in accordance with at least some examples of this invention, e.g., with the locking nut 520 shown in FIG. 5. FIG. 6B illustrates a cross-section along line A-A of the example locking nut stabilizer structure 630 with the retaining member or ball joint 536 not inserted. FIG. 6C illustrates a cross-section along line A-A of the example locking nut stabilizer structure 630 with the retaining member or ball joint 536 inserted. In this example structure, the locking nut stabilizer 630 constitutes a hollow cylinder (or at least partially hollowed out cylinder) that has a continuous opening (640, 640*a*) extending along one of its ends. The side edge openings 640*a* may extend along only a portion of the overall axial length of the stabilizer 630, e.g., from 5-75% of the overall axial length, and in some example structures, from 5-50% or even 5-35% of the overall axial length. The locking nut stabilizer 630 may be made from a rigid, yet flexible material (such as a rigid plastic material) such that the opening 640 will expand somewhat (due to the presence of the side edge openings 640*a* and the hollow interior structure) as a retaining member (e.g., retaining member 536) pushes through and will then snap back to its original size and shape (or substantially its original size and shape) once the widest part of the retaining member 536 is pushed through. If desired, the end surface that defines opening 640 may be sized and shaped to relatively snugly fit around the base portion of the retaining member. The opening 640 and its corresponding retaining member may be appropriate sized and shaped, and the locking nut may be made from suitable materials, such that the locking nut cannot be released from the locking nut stabilizer 630 (or at least cannot be released easily, particularly if there is a recessed head feature, like that shown in FIG. 5). Nonetheless, using this construction, the locking nut stabilizer 630 will hold a locking nut (e.g., locking nut 520) in a rotatable manner.

As another alternative, if desired, the locking nut may include an extending shaft member and the locking nut stabilizer may include a bushing or bearing structure that rotatably engages the locking nut.

Various methods in accordance with examples of this invention will now be described in detail with respect to the structures shown in FIGS. 1A through 4. As one example method in accordance with this invention, a golf club head 102 may be engaged with a shaft 106. This method may include providing a club head body 102 (e.g., by manufacturing it, by purchasing it from a third party source, etc.) including a hosel portion 116, wherein an interior of the club head body 102 includes a locking nut stabilizer 130. This locking nut stabilizer 130 may be engaged with the club head body 102 (e.g., by cements or adhesives, by fusing techniques, by mechanical connectors, etc.) or may be integrally formed in the interior of the club head body 102. Additionally, this method may include providing a shaft 106 (e.g., by manufacturing it, by purchasing it from a third party source, etc.), wherein a first end of the shaft 106 includes a retaining member 110 (which optionally may be included as a shaft adapter part 112).

The method further may include engaging a locking nut 120 with a side surface of the club head body 102 (e.g., at the club head heel area) such that a body portion 132 of the locking nut 120 extends at least partially through the hosel portion 116 and is supported by the locking nut stabilizer 130. As noted above, the body portion 132 of the locking nut 120 includes an opening 134 defined therein, wherein the opening 134 includes an enlarged portion 134*a* and a narrowed portion 134*b*.

Once the various parts are provided and readied, the golf club may be assembled by inserting the first end of the shaft 106 into the hosel portion 116 such that the retaining member 110 at least partially passes through the enlarged portion 134*a* of the opening 134 in the locking nut body portion 132. Optionally, this insertion step further may engage rotation inhibiting structures 114 provided on the shaft 106 (e.g., on the shaft adapter) and with the club head 102 (e.g., in the hosel or on a club head adapter) to thereby inhibit rotation of the shaft 106 with respect to the club head 102 about the hosel portion 116. Then, the locking nut 120 is moved with respect to the retaining member 110 such that the retaining member 110 moves from an area adjacent the enlarged portion 134*a* of the opening 134 (i.e., from the releasable position) to an area adjacent the narrowed portion 134*b* of the opening 134 (i.e., to the secured position) to thereby engage the shaft 106 with the club head body 102 at a first position.

In some structures in accordance with this invention, the shaft adapter 112 will include an exterior surface that is symmetric about a first axis and an interior chamber for receiving the free end of the shaft 106, wherein the interior chamber is symmetric about a second axis that is non-parallel with the first axis. In other words, such a shaft adapter 112 will allow the shaft 106 to extend outward from the shaft adapter 112 at a different angle from the axial direction of the exterior surface of the shaft adapter. The differences between these axes may be within a range of 0.25 to 8 degrees, and in some examples, within a range of 0.5 to 4 degrees, or even within a range of 0.75 to 2 degrees. In other example structures according to this invention, the shaft 106 will include at least one bend. These structural features allow the various angles of the club head 102 with respect to the shaft 106 to be changed by changing the rotational position of the shaft member with respect to the club head. Examples of these methods are described in more detail below.

For example, starting with an assembled golf club head, as described above, additional methods according to some examples of this invention may further include moving the locking nut 120 with respect to the retaining member 110 such that the retaining member 110 moves from the area adjacent the narrowed portion 134*b* of the opening 134 (i.e., from the secured position) to the area adjacent the enlarged portion 134*a* of the opening 134 (i.e., to the releasable position). Then, the shaft 106 may be removed from the locking nut 120 (and optionally from the entire club head body 102) by pulling the retaining member 110 away from the locking nut body portion 132 and through the enlarged portion 134*a* of the opening 134. Then, the shaft 106 may be rotated with respect to the club head body 102 to a second position that is different from the first position to thereby change at least one of the club head's face angle, loft angle, and/or lie angle as compared to the first position. Then, the shaft 106 may be reinserted into the club head 102 in the same manner as described above and locked into the secured position.

Another example method in accordance with this invention allows interchange of club head bodies on a single shaft. Starting with an assembled club structure as described above, this method further includes moving the locking nut 120 with respect to the retaining member 110 such that the retaining member 110 moves from the area adjacent the narrowed portion 134*b* of the opening 134 to the area adjacent the enlarged portion 134*a* of the opening 134 (i.e., from the secured to the releasable condition). Then, the shaft 106 is removed from the locking nut 120 by pulling the retaining member 110 away from the locking nut body portion 134 and through the enlarged portion 134*a* of the opening 134 and out of the club head 102. Then, a second club head body is provided, having securing structures similar to those described above for the initial club head body (e.g., the same general type of hosel portion, locking nut stabilizer, locking nut (or another compatible locking nut stabilizer and locking nut combination, etc.), etc.). Alternatively, if desired, the locking nut may be removed from the first club head structure and used with the second club head structure. Then, the first end of the shaft 106 is inserted into the hosel portion of the new club head and engaged to the secured position in the same general manner as described above for placing the initial club head 102 in the locked position with respect to the shaft 106.

Still additional aspects of this invention relate to exchanging shafts on a single golf club head. Starting with an assembled club structure as described above, this method further includes moving the locking nut 120 with respect to the retaining member 110 such that the retaining member 110 moves from the area adjacent the narrowed portion 134*b* of the opening 134 to the area adjacent the enlarged portion 134*a* of the opening 134 (i.e., from the secured to the releasable condition). Then, the shaft 106 is removed from the locking nut 120 by pulling the retaining member 110 away from the locking nut body portion 134 and through the enlarged portion 134*a* of the opening 134 and out of the club head 102. The method further includes providing a second shaft (e.g., by manufacturing it, by obtaining it from a third party source, etc.), wherein a first end of the second shaft includes a second retaining member (optionally, as part of a shaft adapter structure like structure 112). The first end of the second shaft then may be inserted into the hosel portion 116 such that the second retaining member at least partially passes through the enlarged portion of the opening in the locking nut body portion. The shaft can be placed in the secured position by moving the locking nut in the manner described above.

Features of this invention are similar in structure and function to features of the invention as described, for example, in U.S. Pat. No. 6,890,269 filed Jul. 17, 2003 in the name of Bruce D. Burrows, U.S. Patent Publication No. 2004-0018886A1 published Jan. 29, 2004 in the names of Bruce D. Burrows, et al., U.S. Patent Publication No. 2005-049072A1 published Mar. 3, 2005 in the names of Bruce D. Burrows, et al., U.S. Patent Publication No. 2007-0265106A1 in the names of Bruce D. Burrows, et al., U.S. Patent Publication No. 2009-0011848A1 published Jan. 8, 2009 in the names of Gary G. Tavares, et al., U.S. Patent Publication No. 2009-0011849A1 published Jan. 8, 2009 in the names of John Tomas Stites, et al., U.S. Patent Publication No. 2009-0011850A1 published Jan. 8, 2009 in the names of John Thomas Stites, et al., U.S. Patent Publication No. 2009-0062029A1 published Mar. 5, 2009 in the names of John Thomas Stites, et al., U.S. patent application Ser. No. 12/404,686 filed Mar. 16, 2009 in the names of Raymond J. Sander, et al., and U.S. patent application Ser. No. 12/366,484 filed Feb. 5, 2009 in the names of John Thomas Stites, et al., which applications are entirely incorporated herein by reference.

CONCLUSION

Of course, many modifications to the golf club heads, golf clubs, releasable golf club head/shaft connection systems, and/or methods for making and/or using these structures may be used without departing from the invention. For example, with respect to the structures, grips, aiming indicia or markings, other indicia or markings, different types of putter heads, various shaft curvatures and/or shapes, various shaft connecting member shapes, and/or other structural elements may be provided and/or modified in the structure without departing from the invention. With respect to the methods, additional steps may be added, various described steps may be omitted, the steps may be changed and/or changed in order, and the like, without departing from the invention. Therefore, while the invention has been described with respect to specific examples including presently preferred modes of carrying out the invention, those skilled in the art will appreciate that there are numerous variations and permutations of the above described structures and methods. Thus, the spirit and scope of the invention should be construed broadly as set forth in the appended claims.

I claim:

1. A golf club, comprising:

a club head body including a hosel portion, wherein an interior of the club head body includes a locking nut stabilizer, wherein the locking nut stabilizer is engaged with the club head body or is integrally formed in the interior of the club head body;

a shaft releasably engaged with the club head body, wherein a first end of the shaft includes a retaining member that is inserted into the hosel portion of the club head body; and a locking nut engaged with a side surface of the club head body such that a body portion of the locking nut extends at least partially through the hosel portion and is supported by the locking nut stabilizer, wherein the body portion of the locking nut includes an opening defined therein, wherein the opening includes an enlarged portion that allows the retaining member to pass through and a narrowed portion for holding the retaining member in engagement with the locking nut, and wherein the locking nut is engaged with the club head body in a movable manner such that the locking nut is movable with respect to the retaining member so as to convert the shaft between a secured condition and a releasable condition with respect to the locking nut.

2. A golf club according to claim 1, wherein the retaining member includes a ball joint, and wherein the opening defined in the body portion of the locking nut includes a round hole as the enlarged portion and a slot extending from the hole as the narrowed portion.

3. A golf club according to claim 1, wherein the retaining member is provided as part of a shaft adapter that is engaged with a free end of a shaft member to thereby form the shaft.

4. A golf club according to claim 3, wherein the hosel portion of the club head body includes a first rotation inhibiting structure that engages a second rotation inhibiting structure on the shaft adapter to prevent rotation of the shaft with respect to the club head body within the hosel portion.

5. A golf club according to claim 3, wherein the shaft adapter has an exterior surface that is symmetric about a first axis and an interior chamber for receiving the free end of the shaft member, wherein the interior chamber is symmetric about a second axis that is non-parallel with the first axis.

6. A golf club according to claim 5, wherein an angle between the first axis and second axis is within a range of 0.25 to 8 degrees.

7. A golf club according to claim 5, wherein an angle between the first axis and second axis is within a range of 0.5 to 4 degrees.

8. A golf club according to claim 5, wherein an angle between the first axis and second axis is within a range of 0.75 to 2 degrees.

9. A golf club according to claim 1, wherein the locking nut stabilizer is integrally formed with a portion of the club head body.

10. A golf club according to claim 1, wherein the locking nut stabilizer is a separate part that is engaged with the club head body.

11. A golf club according to claim 1, wherein the locking nut includes a support member that extends from the body portion and that engages with an opening or recess provided in the locking nut stabilizer to engage the locking nut with the locking nut stabilizer in a rotatable manner.

12. A golf club according to claim 1, wherein the locking nut includes an opening or recess that engages with a projection provided on the locking nut stabilizer to engage the locking nut with the locking nut stabilizer in a rotatable manner.

13. A golf club according to claim 1, wherein the hosel portion of the club head body includes a first rotation inhibiting structure that engages a second rotation inhibiting structure on the shaft adapter to prevent rotation of the shaft with respect to the club head body within the hosel portion.

14. A golf club according to claim 1, wherein the side surface of the club head body at which the locking nut is engaged is located in a heel portion of the club head body.

15. A golf club according to claim 1, wherein the locking nut includes a head portion extending from the body portion, wherein the head portion is exposed at an exterior surface of the club head body, and wherein the body portion extends through the side surface of the club head body.

16. A golf club, comprising:

a club head body including a hosel portion, wherein an interior of the club head body includes a locking nut stabilizer, and wherein the locking nut stabilizer is engaged with the club head body or is integrally formed in the interior of the club head body;

a shaft releasably engaged with the club head body, wherein a first end of the shaft includes a retaining member that is inserted into the hosel portion of the club head body; and a locking nut engaged with a side surface of the club head body, wherein the retaining member engages the locking nut to securely connect the shaft to the club head body, further wherein a body portion of the locking nut extends at least partially through the hosel portion and is supported by the locking nut stabilizer, and further wherein the body portion of the locking nut includes an opening defined therein, wherein the opening includes an enlarged portion that allows the retaining member to pass through and a narrowed portion for holding the retaining member in engagement with the locking nut.

17. A golf club according to claim 16, wherein the opening includes a tapered engagement area.

18. A golf club according to claim 17, wherein the tapered engagement area provides a downward force on the retaining member as the locking nut is rotated.

19. A golf club according to claim 16, wherein the locking nut is engaged with the club head body in a movable manner such that the locking nut is movable with respect to the retaining member so as to convert the shaft between a secured condition and a releasable condition with respect to the locking nut.

20. A golf club according to claim 16, wherein the retaining member includes a ball joint, and wherein the opening defined in the body portion of the locking nut includes a round hole as the enlarged portion and a slot extending from the hole as the narrowed portion.

21. A golf club according to claim 16, wherein the retaining member is provided as part of a shaft adapter that is engaged with a free end of a shaft member to thereby form the shaft.

22. A golf club according to claim 21, wherein the hosel portion of the club head body includes a first rotation inhibiting structure that engages a second rotation inhibiting structure on the shaft adapter to prevent rotation of the shaft with respect to the club head body within the hosel portion.

23. A golf club according to claim 21, wherein the shaft adapter has an exterior surface that is symmetric about a first axis and an interior chamber for receiving the free end of the shaft member, wherein the interior chamber is symmetric about a second axis that is non-parallel with the first axis.

24. A golf club according to claim 16, wherein the locking nut includes a support member that extends from the body portion and that engages an opening or recess provided in the locking nut stabilizer to engage the locking nut with the locking nut stabilizer in a rotatable manner.

25. A golf club according to claim 16, wherein the side surface of the club head body at which the locking nut is engaged is located in a heel portion of the club head body.

26. A golf club according to claim 16, wherein the locking nut includes a head portion extending from the body portion, wherein the head portion is exposed at an exterior surface of the club head body, and wherein the body portion extends through the side surface of the club head body.

27. A golf club, comprising:

a club head body including a hosel portion, wherein an interior of the club head body includes a locking nut stabilizer, and wherein the locking nut stabilizer is engaged with the club head body or is integrally formed in the interior of the club head body;

a shaft releasably engaged with the club head body, wherein a first end of the shaft includes a retaining member that is inserted into the hosel portion of the club head body; and a locking nut engaged with a side surface of the club head body, wherein the retaining member engages the locking nut to securely connect the shaft to the club head body, further wherein a body portion of the locking nut extends at least partially through the hosel portion and is supported by the locking nut stabilizer, and further wherein the body portion of the locking nut includes an opening defined therein, wherein the retaining member includes a ball joint, and wherein the opening defined in the body portion of the locking nut includes a round hole and a slot extending from the hole.

* * * * *